US008037932B2

(12) United States Patent
Carr et al.

(10) Patent No.: US 8,037,932 B2
(45) **Date of Patent: *Oct. 18, 2011**

(54) PIPE HANDLING DEVICE AND SAFETY MECHANISM

(75) Inventors: William Carr, Calgary (CA); Matthew Brown, Calgary (CA); Per G. Angman, Calgary (CA)

(73) Assignee: Tesco Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/683,222

(22) Filed: Jan. 6, 2010

(65) Prior Publication Data

US 2010/0132936 A1 Jun. 3, 2010

Related U.S. Application Data

(63) Continuation of application No. 11/913,761, filed as application No. PCT/CA2006/000759 on May 9, 2006, now Pat. No. 7,673,675.

(60) Provisional application No. 60/594,808, filed on May 9, 2005.

(51) Int. Cl.
*E21B 19/18* (2006.01)

(52) U.S. Cl. ..... 166/77.51; 166/77.52; 166/78.1; 166/380

(58) Field of Classification Search ..... 166/77.51, 166/77.52, 78.1, 85.1, 380
See application file for complete search history.

(56) References Cited

U.S. PATENT DOCUMENTS

| | | | | |
|---|---|---|---|---|
| 3,706,347 | A | 12/1972 | Brown | |
| 3,766,991 | A | 10/1973 | Brown | |
| 3,780,883 | A | 12/1973 | Brown | |
| 3,915,244 | A | 10/1975 | Brown | |
| 4,274,778 | A | 6/1981 | Putnam et al. | |
| 4,625,796 | A | 12/1986 | Boyadjieff | |
| 4,793,422 | A | 12/1988 | Krasnov | |
| 5,107,940 | A | 4/1992 | Berry | |
| 5,515,804 | A * | 5/1996 | Pollack | 114/230.12 |
| 6,276,450 | B1 | 8/2001 | Seneviratne | |
| 6,527,047 | B1 | 3/2003 | Pietras | |
| 7,673,675 | B2 * | 3/2010 | Carr et al. | 166/77.51 |

FOREIGN PATENT DOCUMENTS

| | | |
|---|---|---|
| CA | 2340994 | 3/2000 |
| CA | 2306714 | 11/2000 |
| CA | 2503692 | 5/2003 |
| CA | 2448841 | 5/2005 |
| WO | WO 98/11322 | 3/1998 |
| WO | WO 99/30000 | 6/1999 |

* cited by examiner

OTHER PUBLICATIONS

Society of Petroleum Engineers, SPE/IADC 52770, Case Running Tool by G. H. Kamphorst, G. L. van Wechem, W. Boom, D. Bottger, K. Koch; pp. 89-97, Mar. 9-11, 1999.

*Primary Examiner* — William P Neuder
*Assistant Examiner* — Yong-Suk Ro
(74) *Attorney, Agent, or Firm* — Bracewell Giuliani LLP

(57) ABSTRACT

A pipe handling assembly includes a pipe engaging apparatus having a pipe gripping mechanism connectable to a top drive such that the top drive transmits rotational movement and axial movement to the pipe gripping mechanism. A pipe handling device is mounted onto the pipe engaging apparatus, the pipe handling device including a link hanger mounted on the pipe engaging apparatus. A link arm has a first end pivotally connectable to the link hanger and an outboard end selected to carry a pipe into a position to be gripped by the pipe engaging apparatus. A bearing isolates rotational movement to the pipe gripping mechanism from the link hanger. A connection rigidly connects the link hanger to the pipe engaging apparatus during operation of the pipe handling assembly. The connection is selected to substantially prevent the link hanger from rotating with the pipe gripping mechanism should the bearing seize.

19 Claims, 5 Drawing Sheets

PIPE HANDLING DEVICE AND SAFETY MECHANISM

This application is a continuation of Ser. No. 11/913,761, filed Nov. 6, 2007, now U.S. Pat. No. 7,673,675 which was a national entry of PCT/CA2006/000759, filed May 9, 2006, which claimed priority to U.S. provisional application 60/594,808, filed May 9, 2005.

FIELD OF THE INVENTION

The invention relates to a pipe handling device and a safety mechanism and, in particular, a safety mechanism for a pipe joint handling device in drilling or lining a wellbore.

BACKGROUND

A top drive can be used in a drilling rig for handling a pipe string during drilling or lining a wellbore. In some well operations, an engaging apparatus, including an internal or external pipe gripping mechanism, can be connected below the top drive to grip a joint of pipe, such as casing, so that the engaging apparatus and the joint of pipe can be driven axially and/or rotationally by the top drive. Some engaging apparatus for casing pipe are described in U.S. Pat. No. 6,311,792, issued November 2001 and International application WO00/05483, published February 2000, both to TESCO Corporation.

In a drilling rig, the top drive can be hung in the mast with the engaging apparatus connected in drive communication and in substantial axial alignment therebelow. The top drive and engaging apparatus are hung in the mast above the well center, the top drive and engaging apparatus define a main axis of the drilling rig that is aligned with well center. Joints of pipe, for connection into the drill or liner string, can be supported, for example in a V-door, adjacent the main axis of the drilling rig. For connection into the drill or liner string, the pipe joints can be engaged by an elevator and brought under the drive system for engagement and handling. Generally, the elevator is supported on link arms.

To pick up a pipe joint, the top drive is lowered to permit the elevator, either on conventional link arms or with the cables attached to the link arms, to be manually moved over and engaged about a pipe joint on the V-door. The top drive is then hoisted to pull the pipe joint off the V-door. Once free of the V-door, the pipe joint can be swung by gravity under the engaging apparatus so that the gripping mechanism can engage the pipe joint.

Recently, as described in applicant's United States application 2005-009835, published May 12, 2005, a pipe handling device has been introduced wherein the link arms are mounted to move with the top drive but are mounted below the quill of the top drive such that the link arms can be reduced in length and may be closer to the point of implementation over previous systems. In such assemblies of a pipe handling device with a pipe engaging apparatus, the pipe engaging apparatus includes a pipe gripping mechanism that is selected to grip a pipe for rotation thereof, as driven by a top drive and the pipe handling device includes at least one link arm that are, in normal operation, isolated from such rotation in order to hold and position a pipe for gripping by the pipe gripping mechanism, but not itself be rotated. Although the link arm of the pipe handling device is mounted on the pipe engaging apparatus, a bearing is positioned between the link arms and the pipe gripping mechanism to permit rotational isolation of the link arms from the rotation of the pipe gripping mechanism. The bearing can be provided at various points between the pipe gripping mechanism and the at least one link arm depending on the parts of the pipe engaging apparatus that are connected for rotation with the pipe gripping mechanism and top drive.

For example, in one embodiment, with reference to prior art FIG. 1, a pipe handling device 10 may be provided for mounting onto a pipe engaging apparatus 12. The pipe engaging apparatus may include a main housing 14, a mandrel 16 and a pipe gripping mechanism 17 selected to grip a pipe, for example pipe 22 in the Figure. The apparatus is connectable to a top drive 20, for example through an upper end 18 of mandrel 16 and the top drive provides axial and rotational drive for the pipe gripping mechanism and mandrel of the apparatus, which in turn transmits this rotational and axial movement to a pipe being gripped. In this illustrated embodiment, pipe gripping mechanism 17 and mandrel 16 rotate within a main housing 14 as facilitated by a pipe engaging apparatus bearing 32. Main housing 14 in this embodiment generally is maintained stationary relative to the rotating mechanism 20 and mandrel 16 by use of an anti-rotation bracket 21 installed between top drive 20 and housing 14.

The pipe handling device 10 includes at least one link arm 24 having a first end 25 supported on the pipe engaging apparatus and able to pivotally move thereon and an outboard end 27 pivotally connectable to a pipe elevator segment 30, the link arm being sized to present pipe 22 into a position to be gripped by the pipe engaging apparatus. In the illustrated embodiment, link arm 24 is mounted onto main housing 14 of apparatus 12 through a link hanger 29 formed on a link carrier bracket 19. Link hanger 29 forms a shaft on which link arm 24 can pivot. In this way, link carrier bracket and therefore link arm are moved with the main housing and isolated from rotation with the pipe gripping mechanism by bearing 32 and anti-rotation bracket 21.

Although isolated therefrom by bearing 32, the pipe handling device is located in the rotational drive path of the top drive. Thus, in the event that engaging apparatus bearing 32 should fail and seize, link carrier bracket 31 and link arm 24 have the potential to rotate with the top drive. While anti-rotation bracket 21 is intended to resist rotation of the housing 14, link carrier bracket 19 and the link arm, a seized condition of bearing 32 may cause bracket 21 to also fail, as by breaking or ripping away from its installed position, such that the link arm may begin to rotate as driven by the top drive. Although the top drive would be shut down in this situation, such a situation of uncontrolled rotation of the link arms with the top drive could create significant safety concerns.

SUMMARY

In accordance with one aspect the present invention provides, a pipe handling assembly comprising a pipe engaging apparatus including a pipe gripping mechanism connectable to a top drive such that the top drive transmits rotational movement and axial movement to the pipe gripping mechanism; a pipe handling device for mounting onto the pipe engaging apparatus, the pipe handling device including a link hanger mounted on the pipe engaging apparatus, a link arm having a first end pivotally connectable to the link hanger and an outboard end selected to carry a pipe into a position to be gripped by the pipe engaging apparatus; a bearing for isolating rotational movement to the pipe gripping mechanism from the link hanger; and a connection for rigidly connecting the link hanger to the pipe engaging apparatus during operation of the pipe handling assembly, the connection selected to substantially prevent the link hanger from rotating with the pipe gripping mechanism should the bearing seize.

In accordance with another aspect of the present invention there is provided a pipe handling device for use with a pipe engaging apparatus for gripping a pipe, the pipe engaging apparatus including a main housing, a pipe gripping mechanism, an upper end for drive connection to a top drive and a bearing between the pipe gripping mechanism and the main housing for permitting rotation of the pipe gripping mechanism relative to the housing, the pipe handling device comprising: a link hanger mountable on the main housing of the pipe engaging apparatus; a link arm including a pivotal connection to the link hanger and an outboard end; and a link hanger connection for rigidly connecting the link hanger to the main housing during operation of the pipe engaging apparatus, the link hanger connection selected to substantially prevent the link hanger from rotating with the main housing should the bearing between the pipe gripping mechanism and the main housing seize.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings like reference numerals indicate similar parts throughout the several views. In the drawings.

DETAILED DESCRIPTION

The detailed description set forth below in connection with the appended drawings is intended as a description of various embodiments of the present invention and is not intended to represent the only embodiments contemplated by the inventors. The detailed description includes specific details for the purpose of providing a comprehensive understanding of the present invention. However, it will be apparent to those skilled in the art that the present invention may be practiced without these specific details.

Figure 1:
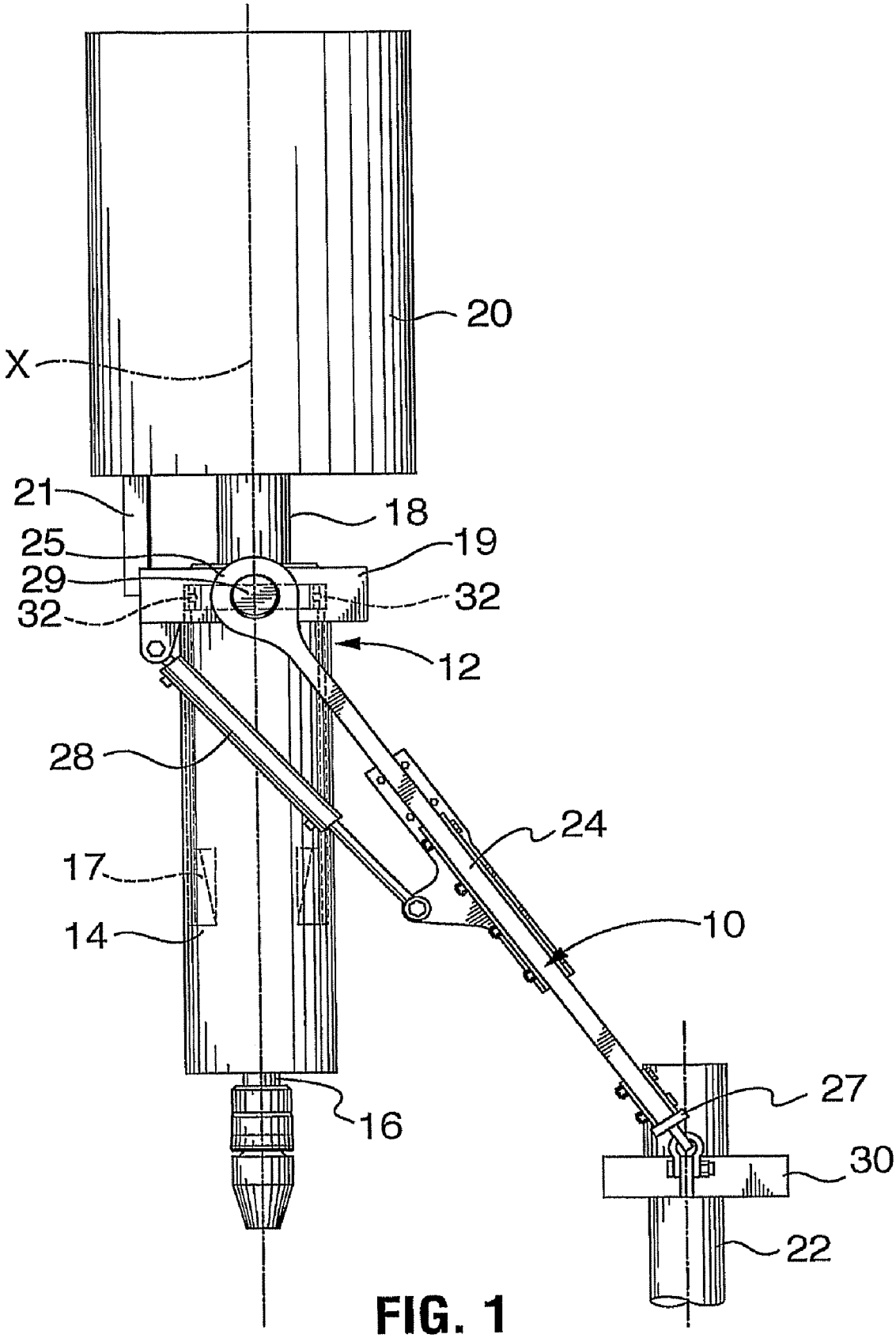
FIG. 1 PRIOR ART
FIG. 1 is a schematic side view of one embodiment of a prior art pipe handling device carrying a pipe elevator and mounted on a pipe engaging apparatus.
Figure 2:
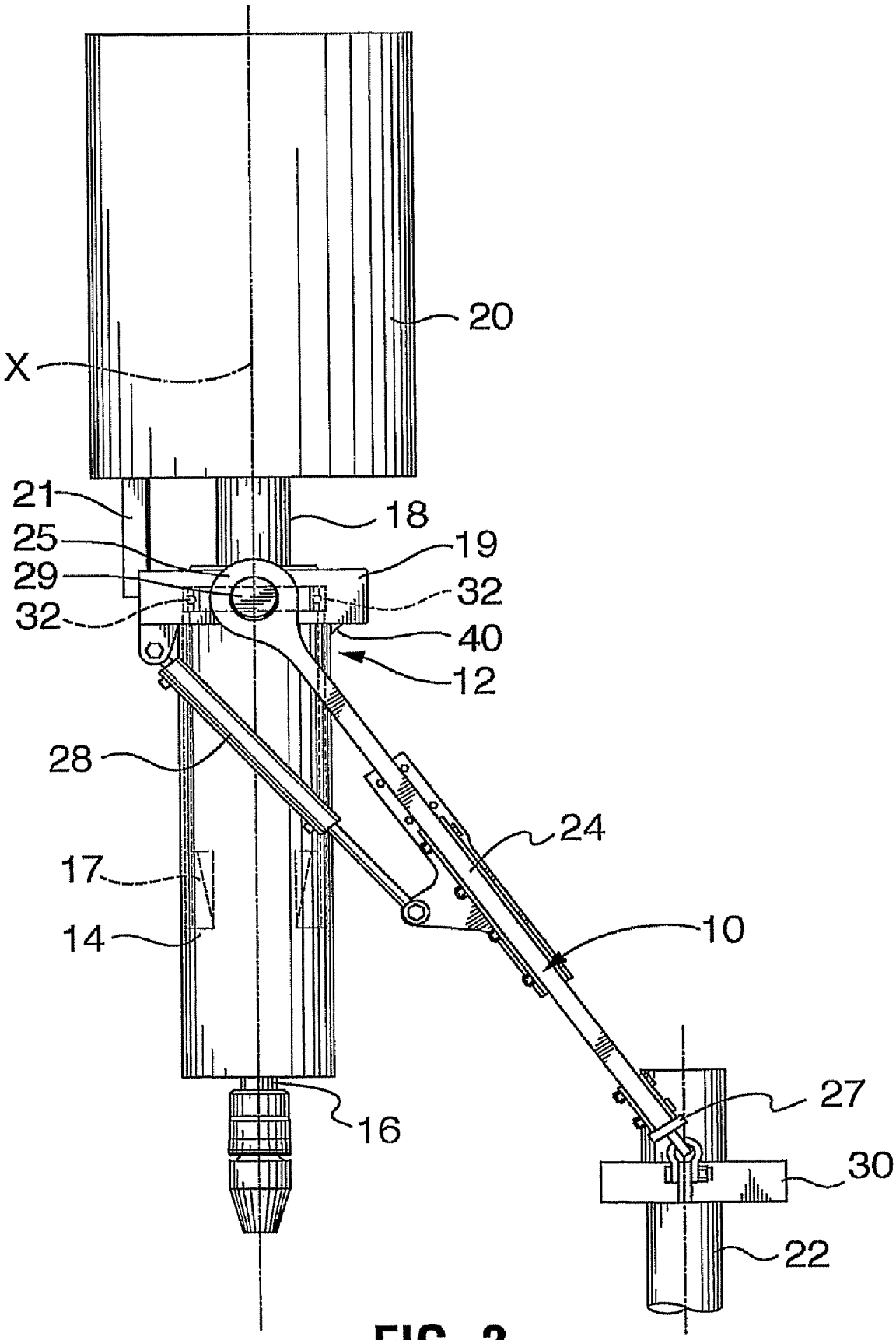
FIG. 2 is a schematic side view of one embodiment of a pipe handling assembly carrying a pipe elevator and mounted on a pipe engaging apparatus.

With reference to FIG. 2, in one embodiment a pipe handling assembly, such as that described in reference to FIG. 1, including a pipe handling device 10 and a pipe engaging apparatus 12 may be provided with a connection 40 between link arm 24 and bearing 32, the connection selected to substantially prevent the link arm hanger 29 from rotating with the pipe gripping mechanism 17 should bearing 32 therebetween seize. Connection 40 can be formed to provide torque limiting breakaway, as by being fusible, shearable, failable, etc. in response to the application of torque beyond a selected maximum to the link arm from top drive 20 through the pipe engaging apparatus. In this embodiment, connection 40 is shown as a fusible link positioned between the link hanger carrier 19 and the main housing 14.

Figure 3:
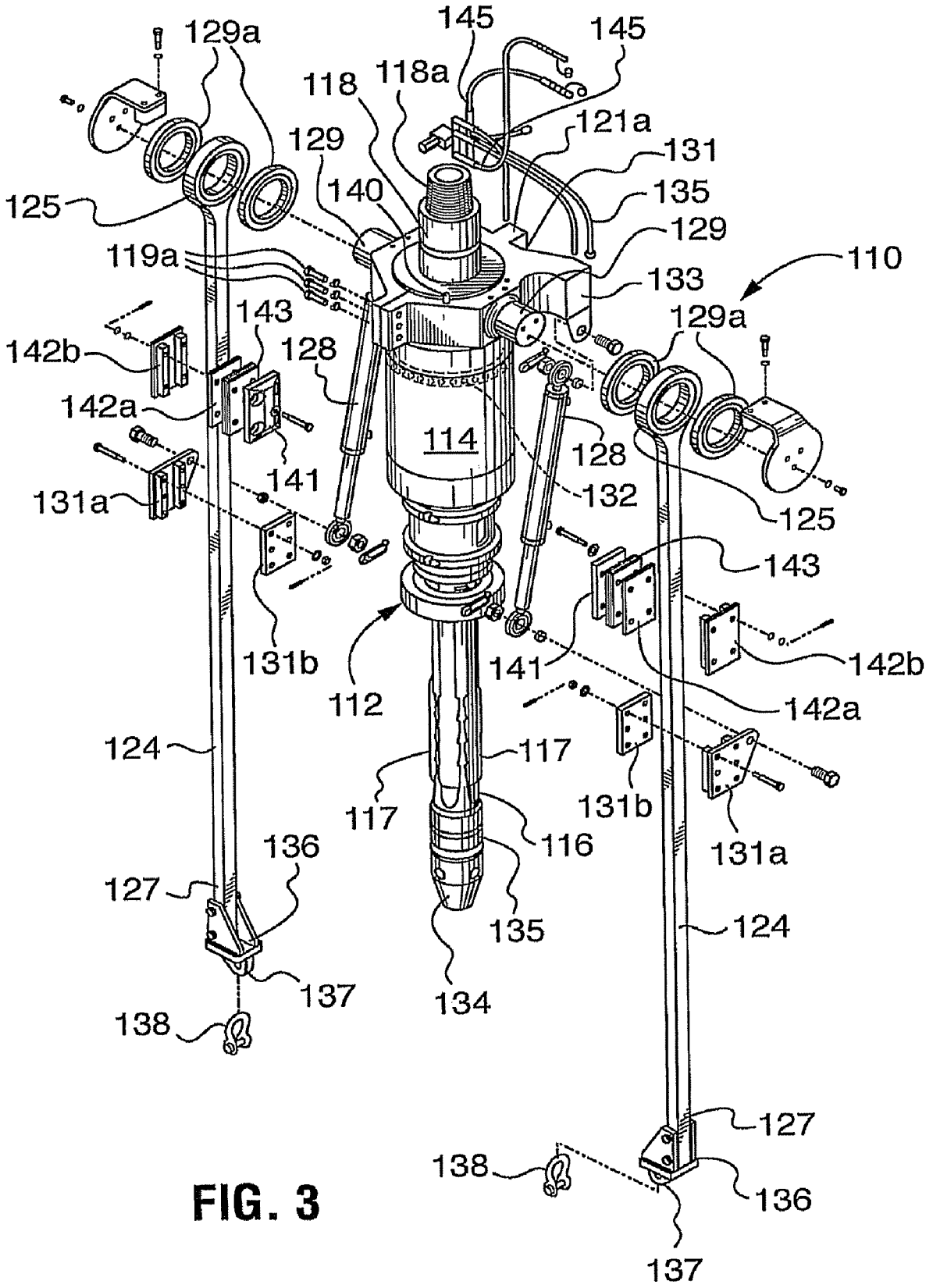
FIG. 3 is an exploded, perspective view of a pipe handling assembly.

In the illustrated embodiment of FIG. 3, another pipe handling device 110 is shown for mounting onto a pipe engaging apparatus 112. The pipe engaging apparatus 112 of FIG. 3 is an internal gripping tool including a main housing 114, a mandrel 116 rotatable relative to the main housing by a bearing 132 and a pipe gripping mechanism 117 for movement with the mandrel and actuation by an actuator that may be for example housed in main housing 114. The pipe engaging apparatus is connectable, for example through the top end 118 of the mandrel, to a top drive (not shown, see FIG. 1) quill such that the top drive transmits rotational and axial movement to the mandrel. The pipe handling device includes a pair of link arms 124 each having a first end 125 pivotally connectable to a link hanger 129 and an outboard end 127 pivotally connectable to a pipe elevator through links 138. The link arms are sized to present a pipe into a position to be gripped by the pipe engaging apparatus and, in particular, by pipe gripping mechanism 117 thereof.

The pipe handling device also includes at least one connection 140 for releasably connecting link hangers 129 to main housing 114 such that during normal operation of the pipe engaging apparatus, link hangers are rigidly connected to the main housing but connection 140 is selected to prevent the link hangers from rotating with the housing should bearing 132 between the mandrel and the main housing fail and seize.

Of course, the pipe handling device may be incorporated to provide an overall pipe handling assembly with a safety mechanism provided by a connection 140 to prevent uncontrolled swinging of the link arms with the top drive, should the bearing between the mandrel and the main housing of the pipe engaging apparatus become seized. In one embodiment, it may be desirable to employ breakaway hose fittings 145 on the pipe handling assembly as a further safety measure to reduce the hazard of "whipping" hydraulic/power hoses 135 in the event of a bearing seizure.

The pipe engaging apparatus and the pipe handling device may take various forms some of which are disclosed in the patent applications of TESCO Corporation set out above. For example, in one embodiment as shown, link hangers 129 are mounted on or formed as a part of a link carrier bracket 131 that mounts on main housing 114 of the pipe engaging apparatus. Bracket 131 can include a key 121*a* or other means to connect to the anti-rotation bracket (not shown, FIG. 1) extending down from the top drive.

Pipe handling device 110 can be used to bring a section of casing from a pipe supply into a position for engagement by pipe engaging apparatus 112. For a quick review of the components and structure of a pipe handling device, note that the illustrated pipe handling device bracket 131 is mounted on the pipe engaging apparatus by clamping bolts 119*a*.

The bracket 131 forms the link hangers on which the first and second link arms 124 are mounted for pivotal movement. The first and second link arms can each include a link eye end 125 mountable onto the link hangers. Washers 129*a* can be mounted on link hangers 129 on either side of the link arm link eye ends 125 to maintain alignment of the arms on the link hangers and to tend to maintain the arms in a laterally stable position, stabilized to rotate substantially only in a plane substantially orthogonally to link hangers 129. In the illustrated embodiment, the link hangers are coaxial such that arms 124 rotate in planes parallel to each other. The use of lateral stabilizers, such as washers 129*a*, can tend to hold link arms equidistant from the main axis of the drilling rig, with which for example, mandrel 116 is aligned. A guard is secured to the bracket at either end of each the link hangers to secure the arms thereto and tightly between washers 129*a*.

Each link arm includes an outboard end 127 that can have a block 136 attached thereto by bolts. Each block includes a pad eye 137 for retaining a clevis 138 for connection to an elevator.

Pipe handling device 110 further can include a drive system for driving link arms 124, 126 to rotate about link hangers 129. The drive system can include hydraulic cylinders 128 each connected between a bracket, formed from parts 131*a*, 131*b*, on their associated link arm and a support 133 formed from bracket 131. Supports 133 can be offset horizontally from vertical axis of link hangers 129 to facilitate control of the link arms with the cylinders. Cylinders 128 are driven by fluid through lines 135. Cylinders 128 can be double acting to provide drive force to move the link arms both clockwise and counterclockwise about their axle shafts. Double acting cylinders and the offset of supports 133 assist in driving the link arms to appropriate positions, for example to bring a pipe section into alignment with, or through in both directions, the rig main axis in which the stabbing guide of the pipe engaging apparatus is aligned. The cylinders can be locked in any desired position, again useful in pipe alignment, and can be unlocked to permit substantially unrestricted movement of the arms.

Pads 141, can be detachably connected, by for example, brackets 142*a*, 142*b* and shims 143, to link arms 124, 126 to maintain a desired spacing between the link arms and the pipe engaging apparatus and to stabilize the arms, when they are in their lower position, extending down substantially with their long axes parallel to the long axis of mandrel 116. Pads 141 can be formed of a material softer than main body 112 so that they do not damage the main body by contact therewith. In one embodiment, for example, the pads can be formed of polymeric material that is softer than the material of the pipe engaging apparatus against which the pads bear. To act to maintain the spacing and to stabilize the arms in their lower position, the pads can be replaced when they become overly worn.

In operation, the pipe handling system is assembled and connected to a top drive in a rig and an elevator is connected to devises 138. If the elevator is mechanized, it can be placed into communication with a connection to an elevator control mechanism, which can for example, be a connection to an electrical and/or hydraulic line. A pipe can be picked up from a V-door by powering cylinders 128 to drive link arms 124 and thereby the elevator carried thereon to a position beneath the pipe so that the elevator can be connected up around the pipe. The pipe is rotated to the vertical position by hoisting the top drive with the cylinders unlocked. The pipe is stabbed into the stump in the rotary table, or if there is not yet a string in the rotary table, is positioned in the rotary table, and the cylinders are driven to align and maintain alignment of the pipe section while the top drive is lowered until the top of the pipe is engaged by the grapples of the pipe engaging apparatus. When lowering the top drive, the elevator, which catches on an upset on the outer diameter of the pipe, will slide down the outside of the pipe, while continuing to hold the pipe upright. At the same time, mandrel 116 and pipe gripping mechanism 117 carried thereon will be inserted into the pipe and can be driven to engage the inner diameter of the pipe. Rotational drive can then be applied from the top drive through the mandrel to the pipe gripping mechanism 117. Bearing 132 isolates the rotation of the mandrel from housing 114 except if the bearing should seize. In such a condition to prevent the link arms from swinging with the housing, which would cause serious safety concerns, connection 140 will breakaway to release the link arm carrier bracket 131 from connection to housing 114.

Connections 40, 140 can take various forms to prevent the link hangers from rotating with the components of the pipe engaging apparatus, such as the pipe gripping mechanism, mandrel and main housing, as driven by the top drive, should bearings 32, 132 between the link hangers and the rotating components of the pipe engaging device fail. Since it is desirable that connections 40, 140 operate to maintain the link hangers secured to the pipe engaging apparatus under normal conditions, but to prevent uncontrolled rotation with the rotating components, for example in the event of a bearing failure, connections 40, 140 can act as a torque limiting breakaway connection, such as a mechanical fuse. Such connections may include, for example, any of welds, fasteners, mechanical interlocks, shear pins, shear bolts, brackets, etc. having characteristics or components selected to fail at a particular torque.

The torque limit at which the connection is selected to fail may be selected to be above that torque generated under normal operating conditions but should be selected to be less than that torque generated to cause failure of the pipe engaging apparatus anti-rotation bracket, which is the point at which the link arms would begin to rotate with the pipe engaging apparatus main housing.

The torsional capacity of a standard anti rotation bracket used on a pipe engaging apparatus is believed to be at least 25,000 in-lbs and possibly 30,000 in-lbs or more or even 40,000 in-lbs or more. Thus the torque limit for the connection may be selected to be less than 25,000 in-lbs or possibly 30,000 in-lbs or possibly 40,000 in-lbs. In one embodiment, the connection is selected to fail at between about 10,000 and 25,000 in-lbs.

A connection may be required between each link arm and its attachment to the pipe engaging apparatus. However, if as shown in the illustrated embodiments of FIGS. 2 and 3, a link carrier bracket 131 is used, for example, to secure one or more link arms to the housing, it may only be necessary to use one connection although more connections could be employed, if desired.

Figure 4A:
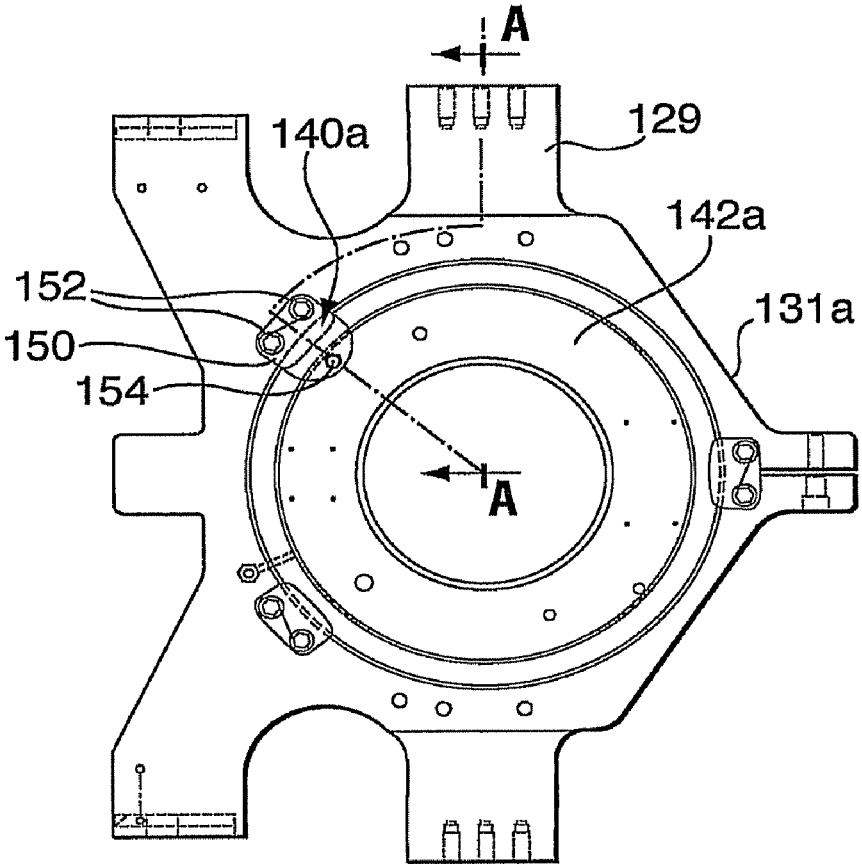
FIGS. 4A and 4B are a top plan view and a section along line A-A, respectively, of a link carrier bracket and top cap useful in a pipe handling assembly.
Figure 4B:
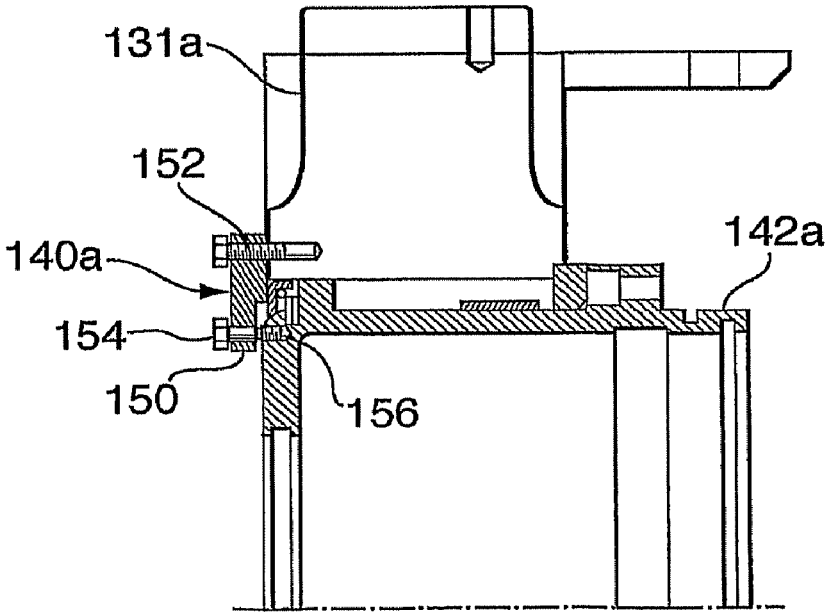
Figure 5A:
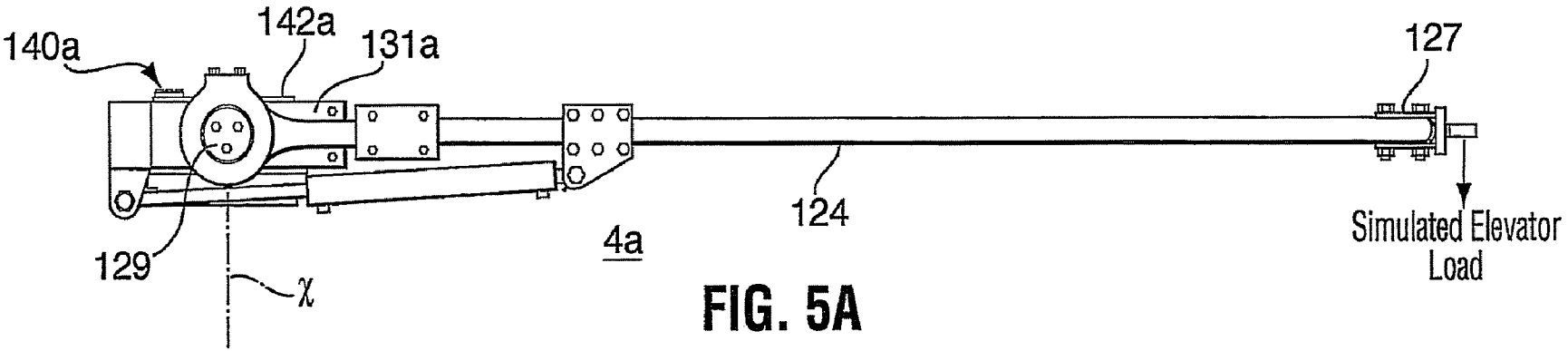
FIGS. 5A and 5B are side elevation and top plan views of a pipe handling device.
Figure 5B:
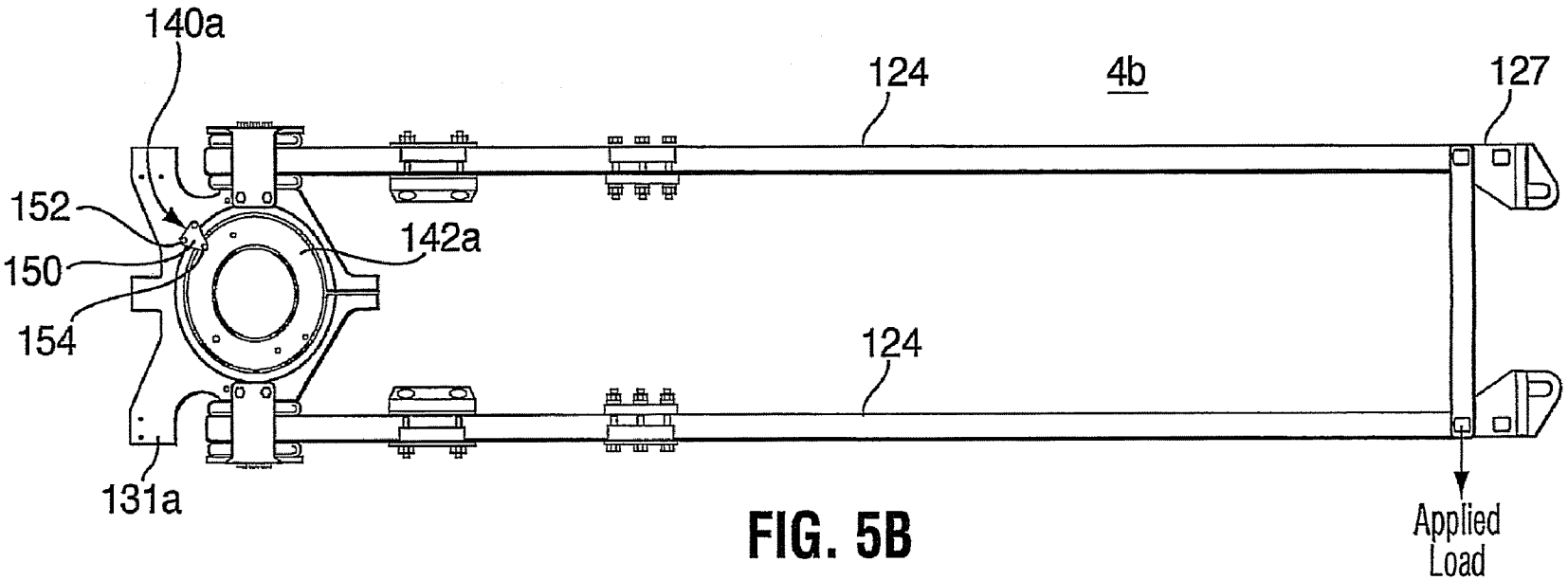

Referring to FIGS. 4 and 5, a link carrier bracket 131 a and a top cap 142*a* are shown with a connection 140*a* therebetween. Top cap 142*a* may be mounted rigidly onto a pipe engaging apparatus, such as onto main housing 114 of FIG. 3, in order to provide a support surface for mounting the link carrier bracket thereon.

Connection 140*a* is selected to rigidly but releasably connect the link carrier bracket to the top cap so that the pipe handling device 110*a* can be mounted to a pipe engaging apparatus through the top cap.

Connection 140*a* includes a bracket 150 securely fastened, in this case via fasteners 152, to bracket 131*a* and a shear pin 154 secured between bracket 150 and a notch 156 in top cap 142*a*. Shear pin 154 is positioned to be acted upon by torque between the top cap, which moves with the pipe engaging apparatus main housing and link carrier bracket 131.

Of course, shear pins could be used in other configurations to provide the breakaway connection between the link hangers and the pipe engaging apparatus, for example without the use of bracket 150, but directly between the parts. Alternately, the bracket could be reversed so that the shear pin engages in a notch on the link carrier bracket, if desired.

EXAMPLE

In a test, an assembly as shown in FIG. 5 was used where the link arms 124 were extended in a maximum forward tilt position (from a normal operating vertical axis of x) with a simulated 400 lb elevator load at outboard ends 127, generating a moment arm of 113¼ inches. The interface between the link carrier arm and the top cap was unlubricated. The assembly was tested with a shear pin, such as shear pin 154 in connection 140*a* and without a shear pin.

Without the shear pin, slippage occurred between the top cap and the link carrier bracket at 80 lbs, which corresponds to a limit torque of 9,060 in-lbs. With the shear pin, 120 lbs were required to break the shear pin. This results in a limit torque of 13,590 in-lbs. The difference between these values (4,530 in-lbs) is the actual torque value required to break the shear pin.

If such a connection was used with an anti rotation bracket that could handle a torque of 39,820 in-lbs, this would provide a safety factor for the safety connection of 2.9:1. Therefore, a torque limit of 13,590 in-lbs for the connection would be very much acceptable.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the scope of protection. Moreover, nothing described herein is intended to be dedicated to the public regardless of whether such disclosure is later explicitly recited in the claims. No element is to be construed under the provisions of 35 USC 112, sixth paragraph, unless the element is expressly recited using the phrase "means for" or "step for".

We claim:

1. An apparatus for making up a string of well pipe with a drilling rig having a top drive, comprising:

a pipe gripping assembly having an inner portion and an outer portion, with bearings located therebetween, the inner portion adapted to be carried by a quill of the top drive for rotation therewith;

an anti-rotation assembly in engagement with the outer portion to prevent rotation of the outer portion while the inner portion rotates;

a link support mounted around and in engagement with the outer portion of the pipe gripping assembly;

a pair of links having upper ends pivotally mounted to the link support;

a pipe elevator carried by lower ends of the links; and a release member located between the link support and the inner portion of the pipe gripping assembly that releases to allow the outer portion of the pipe gripping assembly to rotate relative to the link support in the event the bearings seize and the anti-rotation assembly fails.

2. The apparatus according to claim 1, where the link support has an inner cylindrical surface that is clamped in frictional engagement with an outer cylindrical surface on the outer portion of the pipe gripping assembly.

3. The apparatus according to claim 1, wherein the release member shears at a selected torsional level, and prior to shearing, the release member prevents any rotation between the outer portion of the pipe gripping assembly and the link support.

4. The apparatus according to claim 1, wherein the release member has one portion coupled to the pipe gripping assembly and another portion coupled to the link support.

5. The apparatus according to claim 1, wherein the release member comprises:

a bracket extending over an interface between the outer portion of the pipe gripping assembly and the link support;

a first fastener that secures the bracket to the link support;

a second fastener that secures the bracket to the outer portion of the pipe gripping assembly; and at least one of the fasteners being shearable at a selected torsional level.

6. The apparatus according to claim 5, wherein the selected torsional level is less than torque required to break the anti-rotation assembly.

7. The apparatus according to claim 1, wherein the pipe gripping assembly is hydraulically powered, and wherein the apparatus further comprises:

a breakaway hose connection connected to the pipe gripping assembly for supplying hydraulic fluid to the pipe gripping assembly, the breakaway hose connection releasing from the pipe gripping assembly in the event the bearings seize and the anti-rotation member fails.

8. An apparatus for making up a string of well pipe with a drilling rig having a top drive, comprising:

a mandrel with an upper end for coupling to a quill of the top drive for rotation therewith;

a set of grapples carried by the mandrel for rotation therewith;

a pipe engaging assembly being mounted by bearings to the mandrel and in engagement with the grapples for moving the grapples into and out of engagement with a pipe to be secured to the string;

an anti-rotation assembly in engagement with the pipe engaging assembly, the anti-rotation assembly preventing rotation of the engaging assembly relative to the mandrel;

a link support having an inner circular portion mounted around and in engagement with an outer circular portion of the pipe engaging assembly;

a pair of links having upper ends pivotally mounted to the link support;

a pipe elevator carried by lower ends of the links for supporting the pipe prior to engagement by the grapples; and a release member located between the link support and the pipe engaging assembly that releases at a selected torsional level to allow the pipe engaging assembly to rotate along with the mandrel relative to the link support in the event the bearings seize and the anti-rotation assembly fails.

9. The apparatus according to claim 8, wherein the release member shears at the selected torsional level, and prior to shearing, the release member prevents any rotation between the inner circular portion of the link support and the outer circular portion of the pipe engaging assembly.

10. The apparatus according to claim 8, wherein the release member has one portion coupled to the pipe engaging assembly and another portion coupled to the link support.

11. The apparatus according to claim 8, wherein the inner circular portion is clamped in frictional engagement with the outer circular portion.

12. The apparatus according to claim 8, wherein each of the circular portions comprises a cylindrical surface.

13. The apparatus according to claim 8, wherein the release member comprises:

a bracket extending over an interface between the inner and outer circular portions;

a first fastener that secures the bracket to the link support;

a second fastener that secures the bracket to the pipe engaging assembly; and at least one of the fasteners is shearable at the selected torsional level.

14. The apparatus according to claim 8, wherein the selected torsional level for the release member is less than torque required to cause the anti-rotation assembly to fail.

15. The apparatus according to claim 8, wherein the pipe engaging assembly is hydraulically powered, and wherein the apparatus further comprises:

a breakaway hose connection connected to the pipe engaging assembly for supplying hydraulic fluid to the pipe engaging assembly, the breakaway hose connection releasing from the pipe engaging assembly in the event a selection torsional load is applied to the breakaway hose connection due to seizure of the bearings.

16. An apparatus for making up a string of well pipe with a drilling rig having a top drive, comprising:

a mandrel with an upper end for coupling to a quill of the top drive for rotation therewith;

a set of grapples carried by the mandrel for rotation therewith, the grapples being movable into and out of engagement with a pipe to be secured to the string;

a housing rotatably mounted to the mandrel, the housing having an outer cylindrical portion that is coaxial with an axis of the mandrel;

a link support having an inner cylindrical portion mounted around and in frictional engagement with the cylindrical portion of the housing;

a pair of links having upper ends pivotally mounted to the link support;

a pipe elevator carried by lower ends of the links for supporting a pipe prior to engagement with the grapples; and a shearable member located between the housing and the link support, the shearable member preventing any relative rotation between the housing and the link support unless a selected torsional level is reached.

17. The apparatus according to claim 16, wherein the shearable member has one portion in engagement with the housing and another portion in engagement with the link support.

18. The apparatus according to claim 16, wherein the shearable member comprises:

a bracket extending over an interface between the inner and outer cylindrical portions;

a link support fastener that secures the bracket to the link support;

a housing fastener that secures the bracket to the housing; and at least one of the fasteners being shearable at the selected torsional level.

19. The apparatus according to claim 16, wherein the grapples are hydraulically powered, and wherein the apparatus further comprises:

a breakaway hose connection connected to the housing for supplying hydraulic fluid, the breakaway hose connection releasing from the housing in the event the housing begins to rotate.

* * * * *